United States Patent [19]

Best et al.

[11] 4,394,821

[45] Jul. 26, 1983

[54] DOOR LOCK MECHANISM

[75] Inventors: Walter E. Best; William R. Foshee, both of Indianapolis, Ind.

[73] Assignee: Best Lock Corporation, Indianapolis, Ind.

[21] Appl. No.: 270,825

[22] Filed: Jun. 5, 1981

[51] Int. Cl.[3] ..... E05B 17/04; E05B 63/00

[52] U.S. Cl. ..... 70/422; 70/224; 70/381; 70/380

[58] Field of Search ..... 70/422, 381, 452, 224, 70/373, 379 R, 380

[56] References Cited

U.S. PATENT DOCUMENTS

| | | | |
|---|---|---|---|
| 2,062,765 | 12/1936 | Schlage | 70/91 |
| 2,063,708 | 12/1936 | Swilens | 70/134 |
| 3,206,958 | 9/1965 | Best | 70/373 |
| 3,308,641 | 3/1967 | Russell et al. | 70/224 |
| 3,587,261 | 6/1971 | Berry | 70/422 |
| 3,621,685 | 11/1971 | Sargent | 70/107 |
| 3,955,387 | 5/1976 | Best et al. | 70/224 |
| 4,007,956 | 2/1977 | Harris | 292/347 |
| 4,052,868 | 10/1977 | Best et al. | 70/224 |
| 4,195,502 | 4/1980 | Best et al. | 70/224 |
| 4,312,201 | 1/1982 | Roos | 70/422 |

FOREIGN PATENT DOCUMENTS

| | | | |
|---|---|---|---|
| 2528712 | 1/1977 | Fed. Rep. of Germany | 70/422 |

OTHER PUBLICATIONS

Foshee application Ser. No. 163,472, filed Jun. 27, 1980.

*Primary Examiner*—Robert L. Wolf

*Attorney, Agent, or Firm*—Barnes & Thornburg

[57] ABSTRACT

A doorknob has a neck in rotational bearing engagement on a knob sleeve and has a pair of inner recesses which open inward to engage a driver lug and open axially to be engageable with the lug by axial knob movement. The sleeve has a cross slot adapted to contain a torque-releasable driver, biased outward to engage its lug in a recess, but with the lug so shaped that it will be cammed out of the recess under excess torque on the knob and hence release the knob and prevent transmission of the excess torque to the knob sleeve. Alternatively, the sleeve cross slot may contain a positive driver such as one having end lugs engaged in both recesses, or may contain no driver so that the knob is freely rotatable on the sleeve. The knob has a large end bore closed by a face closure member retained in place by a buried snap ring. The closure member has an inner cylindrical flange embraced by forward portions of the knob sleeve, and contains a key lock mechanism, preferably a key-removable lock core, which is non-rotatable in the closure member and oriented by engagement in a slot in the sleeve. The knob and face closure member form a self-contained assembly in which the closure member can rotate to receive the core in different orientations to suit doors of different hand, and which permits the knob to rotate as needed, without rotation of the spindle and core and closure member, to protect the lock from excess torque or to suit different functions of the lock.

36 Claims, 9 Drawing Figures

DOOR LOCK MECHANISM

This is a continuation-in-part of our co-pending application Serial No. 136,746, filed Apr. 2, 1980, and subsequently abandoned.

The invention of the application relates to door-lock mechanism especially adapted to provide a torque-releasable knob to defeat one form of forced entry attack on such mechanism, but also to provide a knob and knob sleeve construction adapted for use in various applications and functions.

The basic door-lock mechanism may be a cylindrical lock set such as that shown in U.S. Pat. No. 3,955,387 of May 11, 1966, and reference is made to that patent for details of such basic lock mechanism. In a principal "function" or operating mode of such a lock set, the outside knob is mounted on a knob sleeve or spindle which is adapted to be blocked from rotation by manipulation of a turn button or the like in the inside knob, and the outside knob carries a key-actuated lock mechanism for actuating the latch or other bolt of the door when the outside knob is thus blocked from rotation. The key-actuated lock mechanism is desirably a key-removable core, as shown. The knob drives the knob sleeve through a drive and locating ring keyed to both at the outer end of the knob. One method of forced entry attack on such a lock set is to apply a high turning force on the outside knob, as with a pipe wrench or other tool, sufficient to break or overpower the mechanism which blocks the knob spindle from rotation and thus to actuate the knob sleeve to retract the door bolt.

To defeat such attack, U.S. Pat. No. 4,195,502 shows a break-away doorknob connected to its knob sleeve through a ring which breaks under excessive torque. When broken, the ring must be replaced, and this requires removal of the knob. The knob has an end face plate which remains stationary on the knob sleeve and with respect to which the knob rotates when the ring breaks, but such face plate is held in place by, or is part of, the removable key lock mechanism. The present invention provides equal protection against excessive torque on the knob, but does not require replacement of a broken ring, and provides a knob subassembly which includes a face closure member as a self-contained part.

In hotel function locks, it has been customary to fixedly secure the knob against rotation, and such locks are especially subject to attack by applying excess torque to the knobs. Application Ser. No. 071,666, filed Aug. 31, 1979, now U.S. Pat. No. 4,312,201, proposes to defeat such attack by making the knob freely rotatable on the knob sleeve. Again, this uses a knob-supporting face plate which remains stationary with the knob sleeve and is either held in place by, or forms part of, the key-removable core. The mechanism of the present invention is adapted to readily provide the same free rotation of the knob as by omitting the knob driver, but avoids the need to hold a face plate by the key-removable core and instead provides a knob and face closure subassembly which is self-contained and in which the face closure remains in place and is not removed or released when the key-removable core is removed for replacement.

In accordance with the present invention, the knob is mounted for rotation on the axis of the sleeve and has a coaxial part or neck surrounding a part of the sleeve, and means is provided, as desired for the intended function, for connecting the knob to rotate the sleeve. In one preferred application, such means connects the knob to rotate the sleeve, but to release it under excessive torque or relative turning force. Such torque-releasable means comprises a drive lug on one of said parts, preferably the knob sleeve, and movable radially toward the other part, with drive faces on one and cam faces on the other of such lug and other part. Means is provided to bias the lug in a direction to engage said drive and cam faces for transmitting limited torque from the knob to the sleeve for rotating the latter to retract the bolt, and said drive and cam faces are so shaped and said engagement force is such that excessive knob-turning force will cause the lug to be yieldingly cammed to a retracted position to release the normal drive connection from the knob to the sleeve. The excessive knob-turning force is thus not transmitted to the lock mechanism and it remains undamaged. When the knob is rotated to a suitable orientation with respect to the sleeve, the drive lug will re-engage the same or a second set of cam faces to re-establish a normal operating relationship.

The torque-releasable drive mechanism is preferably in the form of a driver mounted for radial movement in the sleeve and carrying a drive lug which projects into a lug-receiving recess in a surrounding portion of the knob. Such portion is desirably a relatively thick portion at the outer end of the knob neck, and the recess is formed as an axial groove in the inner circular face of such portion, which groove opens toward the open end of the knob neck so as to be received over the drive lug by axial movement of the knob onto the knob sleeve. A knob retainer may be mounted in the knob sleeve in adjacent spaced relationship with the driver and arranged to engage a circumferentially continuous radial face beyond the closed end of such groove.

The same knob and sleeve may be used to provide different operating modes as desired or as needed for other lock functions. Thus, to provide a hotel function in which the knob is permanently fixed against rotation, a driver may be used which positively locks the knob to the sleeve. For example, in a preferred construction in which the sleeve has two diametrically opposite lug-receiving recesses, a non-yielding driver may be used which has lugs at both ends engaged in both of the two opposite knob recesses. If a hotel function is desired in which the knob is freely rotatable as in said application Ser. No. 071,666, the knob and sleeve may be assembled without any driver therebetween so that there will be no drive connection and the knob will always rotate freely on the sleeve.

In any rotation of the knob on the sleeve, the key lock mechanism in the knob must remain stationary with the sleeve. Desirably, the knob has a large circular bore in its outer end closed by a face closure member rotatably retained in such opening by a buried snap ring. The face closure member desirably has a generally cylindrical flange at its inner end, and the knob sleeve has forward-extending portions engaged about such flange for supporting the outer end of the knob. The key-removable core or other key-lock mechanism is mounted in an opening or seat in such face closure member with its key plug portion on the axis of the knob sleeve and with its lateral tumbler lobe or flange received in a lateral extension of the seat so that the key-lock mechanism and face closure member are locked against relative rotation. When in place, the lateral flange of the key-lock mechanism is also received between and embraced by the forward-extending sleeve portions of the sleeve so that the key-lock mechanism and face-closure member are oriented thereby about the axis of the knob sleeve. Forced rotation of the knob about the knob sleeve also rotates the knob about the face-closure member and the key-lock mechanism mounted in it, so that the orientation of such mechanism remains the same with respect to the door.

This face closure and key-lock arrangement has the further advantage that the knob and face closure member form a self-contained assembly from which the key-lock mechanism can be removed without endangering the integrity of the lock mechanism, and in which the face closure member can be rotated to receive the key-lock mechanism or core in different orientations to change the hand of the lock for different doors. Such change of hand can thus be done by simply withdrawing a key-removable core, rotating the closure member, and reinserting the core in the new orientation, all without removing the knob or otherwise disassembling the door lock as a whole.

Other features and advantages of the invention will be brought out in the following description of the specific embodiments shown in the accompanying drawings.

The accompanying drawings illustrate the invention and show the best mode presently contemplated for carrying out the invention. In such drawings.

Figure 1:
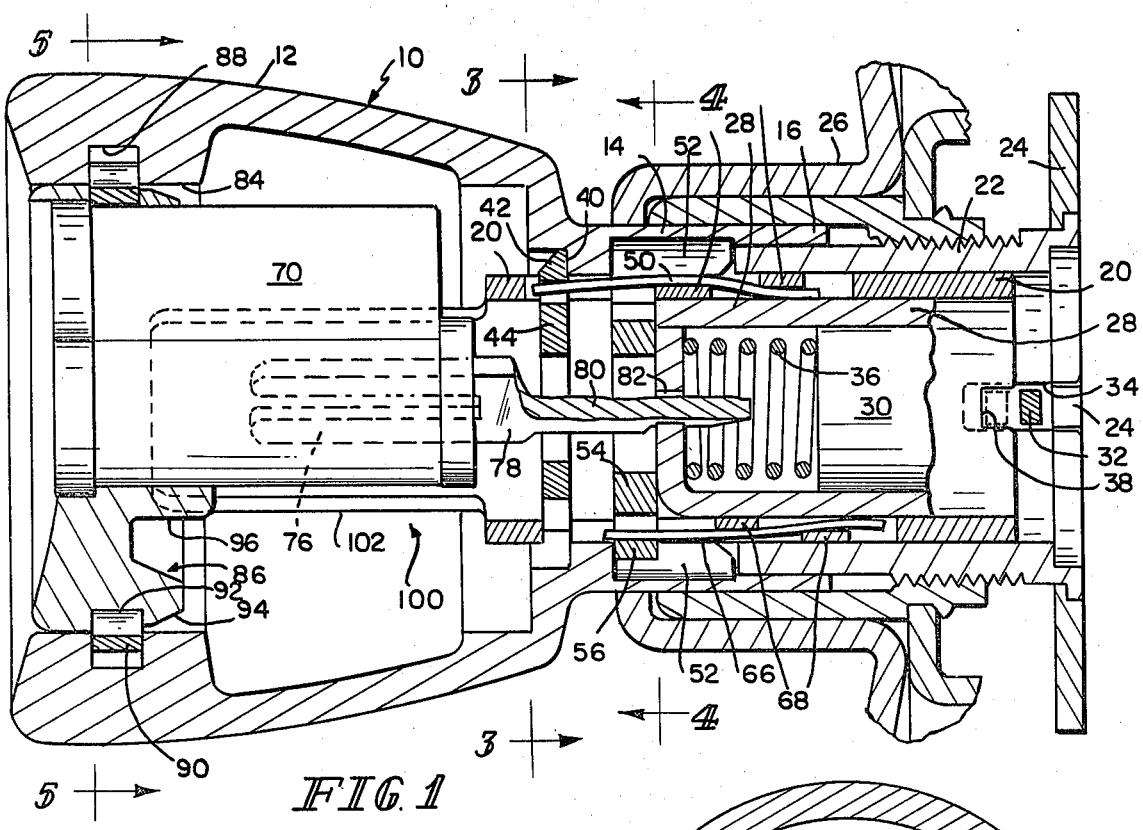
FIG. 1 is a vertical axial section of a doorknob and associated mechanism in accordance with the invention.
Figure 2:
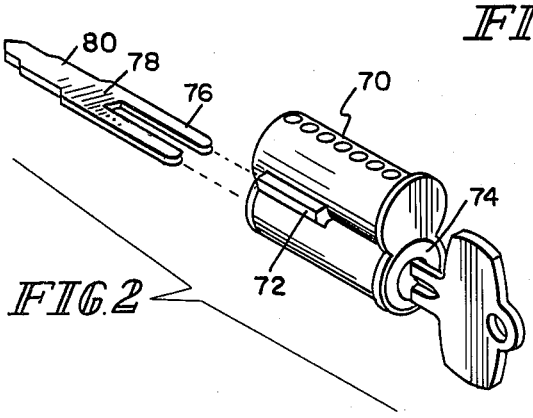
FIG. 2 is a perspective view of a key-removable core of the type preferably used in the knob of FIG. 1, shown in exploded relationship with a throw member for the key plug of such core.

The door-lock mechanism shown in FIGS. 1–5 comprises a doorknob 10 having a hand-hold portion 12 connected at its base to a relatively thick neck portion 14 which in turn connects to a relatively thinner neck portion 16. The knob is mounted on a generally cylindrical knob sleeve 20, primarily by engagement of the inner periphery of its thick neck portion 14 in rotative bearing engagement with the outer surface of the sleeve 20. The sleeve is mounted for rotation in a hub 22 fixed to a chassis side plate 24 of the cylinder lock mechanism, as more fully shown in U.S. Pat. No. 3,955,387. As there shown, the inner end of the knob sleeve 20 carries a roll-back cam (110 in such patent) adapted to engage a retractor for retracting the bolt of the door. FIG. 1 is taken on substantially the same plane as FIG. 2 of such patent, and the roll-back cam lies in front of such plane and is not shown. A trim ring assembly 26 is threaded on the outside of the hub 22 and extends outward into telescopic relation with the knob neck 14–16.

A key-actuated roll-back cam sleeve 28 is rotatably mounted within the knob sleeve 20 and carries at its inner end a second roll-back cam corresponding to the cam 114 in U.S. Pat. No. 3,955,387. This also is in front of the plane of FIG. 1 and hence is not shown in that figure.

For purposes of locking the knob sleeve 20 against rotation and thus to limit lock actuation to that provided by key actuation of the cam sleeve 28, a locking lug bushing 30 (122 in the patent) is slidably mounted within the roll-back cam sleeve 28. As more fully shown in the patent, this carries at its inner end a locking lug 32 which in its normal position extends radially from the bushing 30 outward across the end face of the knob sleeve 20 and into a notch 34 in the hub 22, as shown in full lines in FIG. 1. The bushing is adapted to be moved inward against its biasing spring 36, as by a thumbpiece on the associated inside knob, to carry the locking lug into a notch 38 in the end of the knob sleeve 20 so as to lock such knob sleeve 20 against rotation relative to the hub 22.

Figure 3:
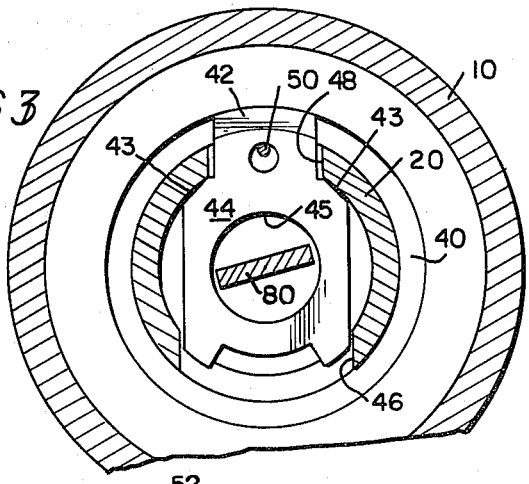
FIG. 3 is a section taken on the line 3—3 of FIG. 1.

For purposes of retaining the knob 10 on the knob sleeve 20, the knob is formed with a circumferentially continuous radial face 40, conveniently at the bottom of a rabbet groove formed in the base of the knob hand-hold portion 12 and at the outer end of the thick portion 14 of the knob neck. Such axial face 40 is engaged by a projecting lug 42 on a knob keeper 44 mounted for radial movement in cross slots in the knob sleeve 20. As shown in FIG. 3, the knob keeper 44 is a generally parallel-sided plate received at its lower end in a wide slot 46 in the knob sleeve, and connected at its opposite end to the narrower lug 42 which is slidably received in a narrower slot 48 in the upper wall of the knob sleeve 20. The keeper is urged outward by a spring 50 engaged in supporting bridges 51 in the wall of the knob sleeve 20, and outward movement of the keeper is limited by engagement of shoulders 43 on its wider portion against the inside surface of the knob sleeve 20 adjacent the narrower slot 48. As shown in FIG. 1, the edge of the keeper lug 42 is beveled so as to be cammed inward by a mating bevel at the opposite end of the thick portion 14 of the knob neck as the knob is thrust onto the knob sleeve 20.

Figure 4:
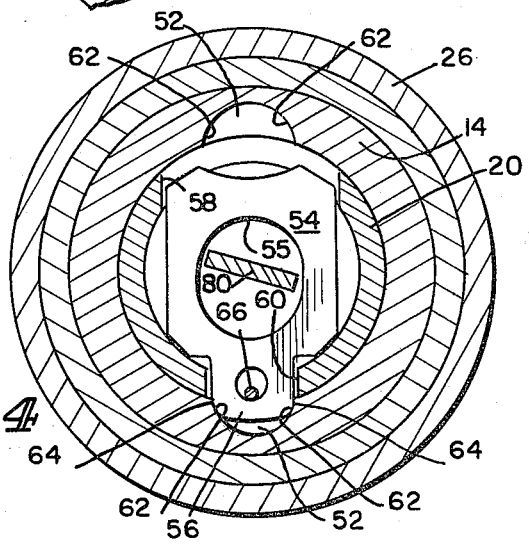
FIG. 4 is a section taken on the line 4—4 of FIG. 1.

For purposes of establishing a torque-releasable drive connection between the knob 10 and the knob sleeve 20, the thick portion 14 of the knob neck is provided with two axial recesses 52 which dead-end at a circumferentially continuous portion of the knob sleeve and extend axially through the end of the thickened portion, and the knob sleeve is provided with a resiliently retractable driver 54 having a drive lug 56 engaged in one of such recesses 52. As shown in FIG. 4, the driver 54 is a generally parallel-sided plate, the wide end of which is slidably received in a wide notch 58 in the top wall of the knob sleeve 20 (as viewed in FIG. 4), and the lug 56 is at the end of a narrower projection of that plate 54 which is received in a narrower slot 60 in the bottom wall of the knob sleeve 20. Radial movement is limited by shoulders 53 at the base of the lug projection, which bear against the sleeve 20. The recess 52 is desirably and conveniently of part circular cross section not greater than, and preferably less than, 180° in arcuate extent. Its side faces adjacent the inner surface of the knob neck portion 14 thus form cam faces 62 in circumferentially spaced and opposed relation. These cam faces are engaged by drive faces 64 on the drive lug 56, which is urged in the direction of such engagement by a leaf-type spring 66 mounted in a seat formed by bridges 68 in the knob sleeve 20.

The shape of the cam faces and drive faces and the biasing force of the spring is made such that the drive lug will transmit normal operating torque from the knob 10 to the knob sleeve to effect normal operation of the lock mechanism controlling the door bolt, but will be incapable of transmitting sufficient torque to damage the locking lug 32 or other parts of the lock mechanism when such locking lug is in its locking position shown in dotted lines in FIG. 1 where it engages the notch 38 in the knob sleeve 20 to lock that knob sleeve 20 against rotation relative to the fixed hub 22. If excessive turning force is applied to the knob 10 when the knob sleeve is thus locked against rotation, the cam face 62 will cam the drive lug 56 inward out of the recess 52, against the bias of the spring 66, and will thus release the drive connection from the knob to the knob sleeve and allow the knob to rotate on the knob sleeve. When the excessive turning force is discontinued, the knob can be turned under moderate force to orient the drive lug 56 in the same or another recess 52 and thus re-establish the normal driving connection between the knob and the knob sleeve.

The hand-hold 12 of the knob 10 contains a key-actuated lock mechanism for driving the roll-back cam sleeve 28 when the knob sleeve 20 is locked against rotation to inactivate the knob. This lock mechanism desirably has a fixed relationship or orientation with respect to the knob sleeve 20, and does not rotate in the event excessive turning force is applied to the knob 10 to cause it to be released from the knob sleeve 20 and turn under such excess force. The key-actuated lock mechanism and the knob 10 is desirably a key-removable core of the type shown in F. E. Best U.S. Pat. No. 3,206,958 and as shown in perspective in FIG. 2. This core 70 is of Figure-8 cross section with a bottom lobe containing a key plug 74 and a top flange or lobe containing pin tumblers. The core also has a retaining lug 72 projecting from its side within the groove formed between the two cylindrical lobes of the core, which serves to retain the core in a suitably formed core chamber, and is retractable with a special control key so as to permit axial withdrawal of the core from the chamber. The key plug 74 has a pair of spaced holes in its rear end adapted to receive the spaced legs 76 of a throw member 78. The throw member is in the form of a flat stamping, and includes a flat tongue portion 80 which extends rearward through openings 45 and 55 in the keeper 44 and driver 54 and into a transverse slot in the rear wall of the key-actuated roll-back cam sleeve 28 so that key rotation of the key plug 74 will be transmitted to such roll-back cam sleeve 28 to cause rotation of it.

Figure 5:
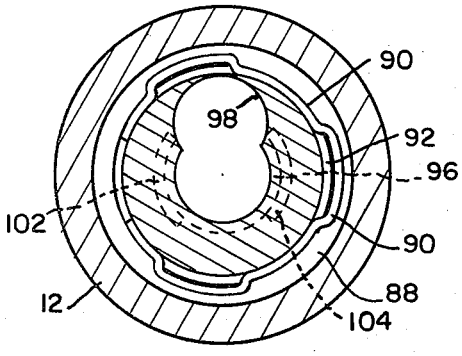
FIG. 5 is a section in reduced scale taken on the line 5—5 of FIG. 1, with the key-removable core removed from the core chamber.

As shown in FIGS. 1 and 5, the outer end of the knob hand-hold 12 is formed with a large cylindrical opening or bore 84 which receives and contains a large circular face closure member 86 large enough to contain the core 70. Such member fits within the circular opening 84 and is retained in place by a buried retainer ring 90. To this end, the knob body surrounding the opening 84 is formed with a relatively deep circumferential groove 88 sufficient to fully retain the resilient retainer ring 90. The outer periphery of the face closure member 86 is formed with a mating shallow groove 92 adapted to receive inner portions of the retaining ring 90, and the rear peripheral edge of the closure member is formed with a bevel 94. In mounting the closure member in the knob, the resilient retainer ring 90 is first inserted in the deep groove 88 of the hand-hold 12, and the closure member 86 is then thrust into the circular opening 84. The beveled surface 94 expands the resilient ring until the groove 92 of the closure member moves into alignment with the groove 88 of the knob, and the resilient retaining ring 90 then snaps into the groove 92 and locks the closure member axially in place but freely rotatable in the knob opening.

Figure 6:
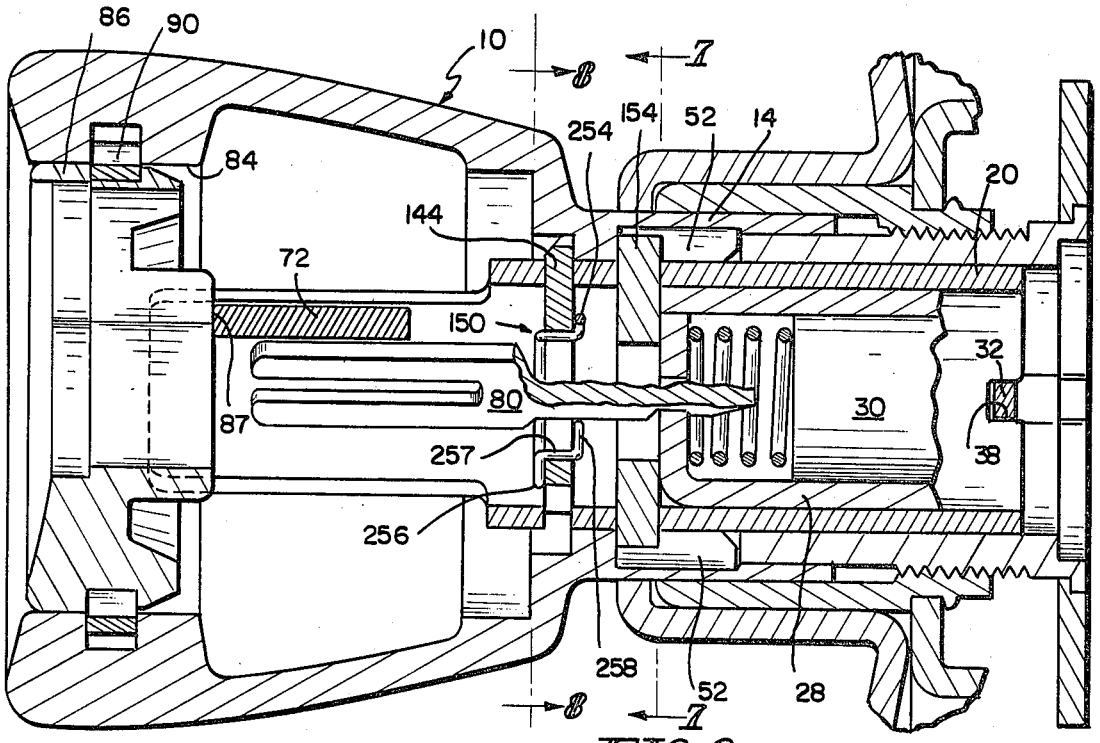
FIG. 6 is a vertical axial section similar to FIG. 1, but with the key-removable core omitted, and showing a non-yielding driver to provide a positive drive between the knob and knob sleeve, and showing a modified biasing spring for the knob keeper.
Figure 8:
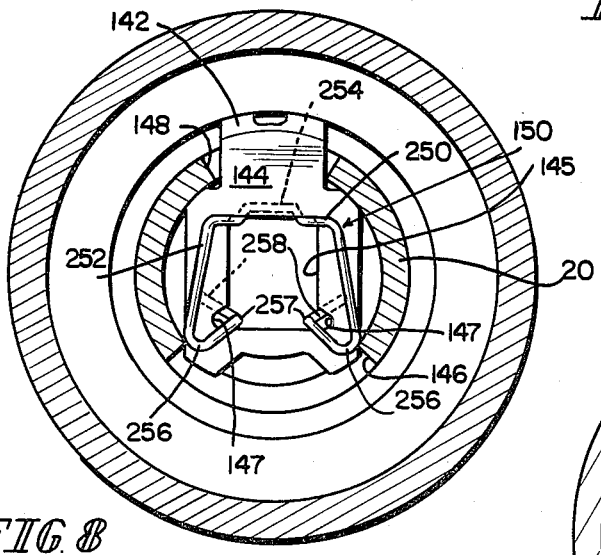
FIG. 8 is a section taken on the line 8—8 of FIG. 6 and showing a modified knob keeper and biasing spring therefor.

For purposes of mounting the core 70 in the closure member 86 and hence in the knob 10, the central portion of the closure member is formed with a rearward-extending generally cylindrical boss 96, and a core chamber 98 of Figure-8 cross section is cut axially through the closure member 86 with one lobe thereof coaxial with the knob 10 and hence with the knob sleeve 20. This leaves only the outer portion of the boss as a generally cylindrical flange, interrupted at the top by the upper lobe of the chamber 98. The coaxial lobe is adapted to contain the bottom lobe of the core containing the key plug 74, while the other lobe of the core chamber is adapted to contain the upper lobe of the core containing the pin tumblers of the lock core. As shown in FIG. 1, the front end of the core chamber is formed with a rabbet groove to receive the edges of the face plate of the core, and the length of the central boss 96 of the closure member 86 is such that its rear face is adapted to form a shoulder 87 for engagement by the core-retaining lug 72 to retain the core in place, as shown in FIG. 6.

For purposes of supporting the outer end of the knob and maintaining a fixed orientation between the knob sleeve 20, the core 70, and the knob-closure member 86, the knob sleeve 20 has a forward portion 100 over which its cylindrical walls are cut to provide two diametrically opposite slots and leave two part-cylindrical tongue portions 102, 104. Such tongue portions extend into embracing relation with the side walls of the cylindrical flange portions of the boss 96 on the rear face of the closure member 86. Also, as shown in FIG. 5, the slots between the tongue portions 102 and 104 are of a width to receive and embrace the upper lobe of a core received in the core chamber 98, and thus to positively orient that core, and through it to orient the closure member 86 about the axis of the knob sleeve 20.

Operation of the door-lock mechanism shown in FIGS. 1–5 is as follows. It is assumed that the parts are in the relationship shown in full lines in those figures. The end of the knob is closed by the closure member 86 and contains a core 70 locked in place by engagement of its retaining lug 72 behind the shoulder 87 (FIG. 6) formed by the end face of the generally circular flange portion of the boss 96. The knob is retained in place by the knob keeper 44, and the knob is drivingly connected to the knob sleeve 20 by engagement of the drive lug 56 in one of the recesses 52 so that a drive connection is established for normal operation of the knob. The knob is then operable manually to rotate the knob sleeve 20 and actuate its roll-back cam to retract the door bolt. If it is desired to limit bolt actuation to key operation, the locking lug 32 is displaced rearward from its full line to its dotted line position where it engages the notch 38 of the knob sleeve 20 and locks that knob sleeve against rotation. The lock mechanism is then adapted to be operated only by a suitable key inserted in the key plug 74 of the core 70 and rotated in the usual way to rotate the throw member 80 and hence rotate the roll-back cam sleeve 28 to cause its roll-back cam to operate the retractor and retract the bolt of the door.

If an attempt is made to force the lock by applying excessive turning force on the knob 10, this will cause the cam faces 62 engaged by the drive faces 64 on the drive lug 56 to cam such drive lug radially inward out of engagement with its recess 52, and hence release the knob from driving engagement with the knob sleeve 20. The shapes of the cam faces 62 and drive faces 64 and the force of the spring 66 are made such that the driving connection will be released under a torque which is insufficient to damage the locking lug 32 or other parts of the lock mechanism, and the attempt to force the lock will be defeated without damaging the lock mechanism. Normal operating relationship of the parts can be re-established by rotating the knob under moderate force until the drive lug 56 is brought into alignment with the same or another recess 52 so that the lug can enter that recess and re-establish the normal operating conditions. Such re-establishment of normal operating conditions will occur as the result of normal operation of the lock, and no special servicing of the mechanism will be required.

The knob 10 and face closure member form a self-contained knob assembly which is assembled to the knob sleeve in a substantially conventional manner. The knob assembly, without a core 70 therein, is moved axially onto the knob sleeve 20 and a hub 22. The beveled face of the knob-keeper lug 42 will engage the beveled face at the end of the thick portion 14 of the knob neck, and the knob keeper will be cammed radially inward to pass the knob toward its seated position. When the end of the thick portion 14 of the knob neck approaches the cam lug 56, the knob is rotated to orient a recess 52 with that lug 56, so that such lug 56 will enter the recess 52 and allow the knob to be moved to its assembled position as shown in FIG. 1. The core and throw member can then be assembled.

Removal of the knob from the knob sleeve is prevented since the knob keeper is wholly buried behind the core 70 which is removable only by the use of a special key. To remove the knob, such a special key is used to first remove the core 70, the throw member 80 is also removed, and a tool is then inserted through the core chamber 98 into engagement with the knob keeper 44 to retract it from its keeper position and release the knob for axial removal.

Figure 7:
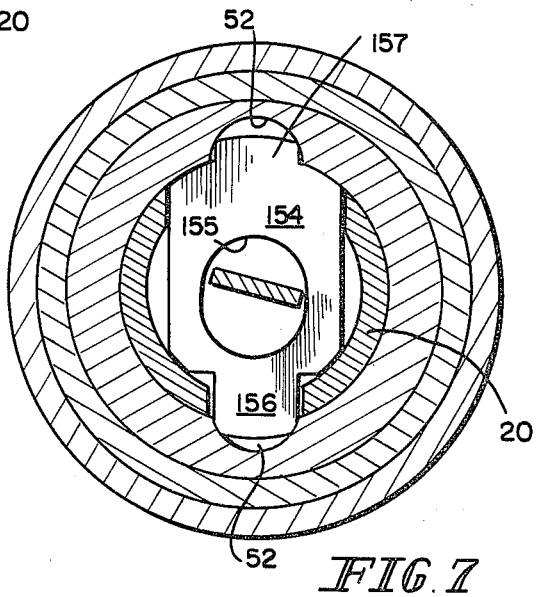
FIG. 7 is a section taken on the line 7—7 of FIG. 6 and showing the non-yielding driver.

The door-lock mechanism shown in FIGS. 6 and 7 shows a modified and presently preferred form of biasing spring 150 for the knob keeper 144, and is primarily modified to provide a hotel function door-lock mechanism in which the knob is positively and permanently fixed against rotation and the lock mechanism is operable only by key operation of the key lock mechanism 70 contained in the knob. Such modified door-lock mechanism comprises a knob 10 identical with that shown in FIG. 1, having a large end opening 84 closed by a face closure member 86 held rotatably in place by a trapped ring 90. The neck portion 14 of the knob is mounted in rotative bearing engagement with the outer surface of the knob sleeve 20, and contains two diametrically opposite recesses 52 which open inward to receive drive lugs and which open axially toward the open end of the knob neck and toward the inner end of the knob sleeve 20 so as to be engageable with such lugs by axial movement of the knob onto the knob sleeve 20. In this hotel function, the knob sleeve 20 is permanently locked against rotation by fixedly positioning the locking lug 32 in the notch 38 at the inner end of such knob sleeve. as by securing the bushing 30, which carries the lug 32, in a retracted position relative to the cam sleeve 28 as by a pin or other conventional means, not shown.

In this hotel function modification of the door-lock mechanism which omits the torque-releasable feature of FIGS. 1–5, or in any corresponding modification in which it is desired that the knob 10 positively drive the knob sleeve 20, the knob is connected to the knob sleeve 20 by a positive driver 154 mounted in the same place as the torque-releasable driver 54. As shown in FIGS. 6 and 7, this may take the same general shape as the driver 54 of FIGS. 1 and 4, with a drive lug 156 at its bottom end, but also with a drive lug 157 at its upper end. The two drive lugs 156 and 157 are engaged in the opposite recesses 52 of the knob neck and are unyieldingly held therein by the interconnecting strut-like body of the driver 154. They thus positively transmit torque from the knob to the knob sleeve, and positively lock those two parts against relative rotation. As in the modification of FIGS. 1 and 4, the driver 154 has a central opening 155 to pass the end of the throw member 80 therethrough into driving engagement with the rear wall of the key-actuated cam sleeve 28.

In FIGS. 6 and 8, the knob 10 is held axially in place on the cam sleeve 20 by a knob retainer 144 mounted in a pair of diametrically opposite slots 146 and 148 in the knob sleeve 20. The outer peripheral shape of the knob keeper 144 is similar to that of the knob keeper 44, and its function is the same. However, it is biased to engagement by a different biasing spring 150 and its central opening 145 is modified to accommodate that spring. Such opening 145 is generally rectangular and somewhat longer in the direction of the keeper lug 42 than transversely thereof, and at its opposite end is formed with a pair of side notches 147 to accommodate the legs of the spring 150.

The spring 150 is a generally U-shaped spring with a transverse leg 250 and two side legs 252. A central bight portion 254 of the leg 250 is bent rearward through the opening 145 and then upward to engage behind the opposite face of the keeper 144. The side legs 252 extend downward and outward along the front face of the keeper, and at their ends are bent inward in their planes to form curved heel portions 256 adapted to bear against downward converging side face portions of the inner surface of the knob sleeve 20. The side legs extend upward and inward from such heel portions 256, and are then bent rearward to form hook portions 257 extending through the opening 145 of the keeper, and are bent thence outward and upward to form toe portions 258 overlying the opposite or rear face of the keeper 144. The hook portions 257 ride on the bottom edge of the opening 145 and have the effect of urging the spring as a whole upward to maintain its central bight 254 hooked behind the back face of the keeper 144 at the top of the opening 145, and spring 150 is thus normally locked in place in the keeper 144 and forms a self-contained subassembly therewith. In unstressed condition of the springs, that is, if the subassembly is not mounted within a cylindrical knob sleeve 20, the side legs 252 will be splayed outward to a position in which their hook portions 257 are spring-pressed into the side notches 147, with the toe portions 258 of the spring engaged behind the back face of the keeper 144.

The spring 150 and its function are similar to what is shown in the co-pending application of one of the present inventors (Foshee), Ser. No. 06/163,472, filed June 27, 1980. In operation, the side legs of the spring are bent inward and stressed by engagement of their heel portions 256 against downward converging faces of the surrounding cylindrical knob sleeve and exert force thereon so as to produce a camming reaction tending to force the spring upward in the direction of the retaining lug 142, and hence to urge that lug outward to its knob-keeping position as shown in FIGS. 6 and 8. The use of this spring 150 which is self-retaining on the knob keeper 144 eliminates the necessity for the bar or leaf spring 50 shown in FIGS. 1 and 3, and thus clears the way for the upward-projecting driver lug 157 on the knob driver 154.

Figure 9:
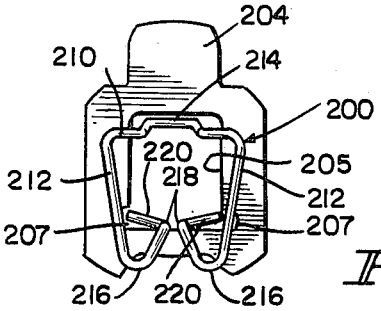
FIG. 9 is an elevation showing a biasing spring like that of FIG. 8 in association with a torque-releasable knob driver having a modified central opening to accommodate such spring, and with the spring in an intermediate position of assembly with the driver.

A similar spring may be used to bias a torque-releasable driver like that of the driver 54 of FIGS. 1 and 4, and hence to eliminate the necessity for the leaf or bar spring 66 and the difficultly formable seats 68 required by that bar spring 66. This is illustrated in FIG. 9, in which a spring 200 is shown in association with a torque-releasable driver 202 similar to that of the driver 54 in FIG. 4, but oriented with its driving lug 204 at the top instead of the bottom. The driver contains a central opening 205 of rectangular shape like that shown in FIG. 8, and with bottom side notches 207. The spring 200, which is shown in partially assembled position, has a transverse leg 210 which includes a rearwardly and upwardly offset central bight 214. The spring has side legs 212 connected to heel portions 216 which lead to hooks 218 extending through the opening 205 and connected to outward-extending toe portions 220. In the condition shown, the side legs of the spring 200 are resiliently bent inward to carry their toe portions 220 to positions within the area of the central opening 205, so that the spring can be passed through such opening to position its upper bight 214 and its toe portions 220 behind the rear face of the driver. The spring is then allowed to expand and its side legs spring outward and the spring moves upward to a position in which the spring is engaged with the keeper in a self-supporting relationship, in the same manner as in FIG. 8. The knob driver 202 is desirably thicker than the knob keeper 144, and to accommodate the extra thickness, the portions of the spring 200 which extend through the driver are made longer than the corresponding parts of the spring 150.

When a driver 202 and spring 200 are to be used in a door-lock mechanism as shown in FIG. 1, it is necessary to provide sufficient clearance on both sides of the driver to accommodate the spring, and this may be done by slightly shortening the cam sleeve 28 to provide such clearance on the back side of the driver. When the driver 202 and spring 200 are installed in the knob sleeve, the heel portions 216 ride against downward-converging face portions of the sleeve so as to cam the driver in the direction of its driver lug 204 and hence bias that lug in torque-releasable engagement with a knob recess 52.

Operation of a lock containing a keeper 144 and a torque-releasable driver 202 will be similar to that of the lock of FIGS. 1-5. Operation of a lock containing a positive driver 154 will be similar except that the knob 10 will be positively locked to the sleeve 20.

The door-lock mechanism of the present invention, and particularly the self-contained knob assembly and its mounting on the knob sleeve shown, is adapted to advantageously provide a number of different operating features in locks having various different functions. Thus, the knob assembly including a face closure member 86 rotatable secured in the end of the knob may be assembled with a knob sleeve 20 with a torque-releasable driver 54 (FIG. 1) or 202 (FIG. 9) to provide a torque-releasable knob in any of various lock functions. The same knob assembly and knob sleeve may be assembled with a positive driver 154 to provide a positive drive connection between the knob and knob sleeve in a door lock having a hotel function in which the knob is fixed against rotation or having other functions in which it is desired to have the knob in positive driving relation with the knob sleeve. Further, the same knob assembly and knob sleeve may be assembled without any driver to provide a door lock in which the knob is always freely rotatable and never operable to rotate the knob sleeve and retract the bolt, and thus to provide a mode of operation analogous to that shown in application Ser. No. 071,666. Further, door lock sets may be packaged and sold with alternate parts, such as with both a torque-releasable driver 54 or 202 and with a positive driver 154 so that the lock set can be easily modified in the field or by a distributor to suit the desired application, by simply removing the knob and changing the driver.

In all of these applications, the self-contained knob assembly holds the end closure member in secure but rotative relation in the end of the knob where it will permit rotation of the knob relative to the knob sleeve in any door lock in which such rotation is otherwise possible. Moreover, in any of these arrangements, the end closure member provides a supporting connection from the knob sleeve to the outer end of the knob, and is rotatable to different orientations to permit the key-removable lock core to be inserted in either of alternative orientations, as to adapt the lock mechanism to doors of different hand.

We claim:

1. Door-lock mechanism having a torque-releasable knob, comprising a knob sleeve mounted for rotation on its axis and connected to retract a door bolt, means for locking the sleeve against rotation to prevent it from retracting the bolt, a knob mounted for rotation on the axis of the sleeve and having a coaxial part surrounding a part of the sleeve, means for normally connecting the knob to rotate the sleeve to retract the bolt, and releasable under excessive relative turning force, said means comprising a drive lug mounted on one of said parts and movable toward the other, drive faces on one and cam faces on the other of said lug and other part, means biasing the lug in a direction to engage said drive and cam faces for transmitting limited torque from the knob to the knob sleeve for rotating the latter to retract the bolt, said drive and cam faces being so shaped and said biasing means having such force that excessive knob-turning force will cause the lug to be yieldingly cammed to a retracted position to release the normal drive connection from the knob to the sleeve.

2. Door-lock mechanism as in claim 1 in which said normally connecting means comprises a driver mounted for radial movement in the sleeve and carries a drive lug having circumferentially spaced drive faces, the surrounding portion of the knob contains a lug-receiving recess having cam faces engageable by said drive faces.

3. Door-lock mechanism as in claim 2 in which said sleeve is formed with a relatively larger radial slot at one side and a relatively smaller radial slot diametrically opposite the large slot, and the driver has a large portion slidably received in said larger slot and a smaller lug portion slidably received in the smaller slot and extending therethrough into engagement with the recess.

4. Door-lock mechanism as in claim 3 in which the driver has a stop shoulder at the base of the lug engageable with a surface of the sleeve to limit outward movement of the lug.

5. Door-lock mechanism as in claim 3 in which the driver is a plate-like member having a central opening to provide an axial clearance path through the sleeve.

6. Door-lock mechanism as in claim 2 which includes a stationary hub in which the knob sleeve is rotatably mounted and said knob has a neck portion surrounding the sleeve at the end of the hub and containing at least one axial groove forming a lug-receiving recess and open axially toward the hub, said driver being mounted in the sleeve within said neck portion with its drive lug engaged in said axial groove so as to be engageable and disengageable therefrom by axial movement of the knob on the sleeve.

7. Door-lock mechanism as in claim 6 with the addition that the knob includes a circumferentially continuous radial face axially outward beyond said axial groove, and a knob keeper mounted in the sleeve and engaging such radial face to retain the knob on the sleeve.

8. Door-lock mechanism as in claim 7 in which the knob retainer is mounted for radial movement in the sleeve in a direction angularly displaced from that of the driver.

9. Door-lock mechanism as in claim 7 in which the knob retainer is mounted for radial movement in the sleeve in a direction diametrically opposite that of the driver, and in which the knob retainer and driver are spring-pressed in opposite directions.

10. Door-lock mechanism as in claim 8 in which the knob retainer and driver are spring-pressed in opposite directions by leaf-type springs mounted in spring seats at angularly spaced locations on the sleeve.

11. Door-lock mechanism as in claim 1 in which said knob has a large circular opening in its outer end, a face closure member rotatably mounted in said opening and having a generally cylindrical flange at its inner end, said knob sleeve having forward extending portions engaged about said flange for supporting the outer end of the knob.

12. Door-lock mechanism as in claim 11 in which said face closure member supports a key-lock mechanism having a key-plug portion on the axis of the knob sleeve and a lateral tumbler flange, said forward-extending sleeve portions defining a slot in which said flange is received and embraced so as to orient the key-lock mechanism and face closure member about the axis of the knob sleeve.

13. Door-lock mechanism as in claim 12 in which said key lock mechanism is a key-removable core having a key-retractable retaining lug projecting laterally therefrom, and engaged behind a rearward-facing shoulder on said face closure member.

14. Door-lock mechanism as in claim 11 in which said knob opening and face closure member have facing peripheral grooves at the circular interface therebetween, and a retaining ring contained in and bridging said grooves to secure the closure member in said opening.

15. Door-lock mechanism as in claim 14 in which one of said grooves is of a size to contain the retaining ring and such ring is a resilient ring adapted to be flexibly retracted into such groove as the closure member is mounted on the knob and to snap into the opposite groove when the same comes into alignment therewith.

16. Door-lock mechanism, comprising a knob sleeve having a generally cylindrical knob-receiving portion, a knob having a handhold portion and a generally cylindrical neck portion surrounding said sleeve and containing at least one inner lug-receiving recess open inward and axially toward the inner end of the sleeve, a knob driver mounted transversely in the sleeve and having a driver lug projecting radially from the sleeve and engaged in said recess, such recess and lug being engageable and disengageable by axial movement of the knob on the sleeve, and means to secure the knob axially in place on the sleeve with said lug engaged in said recess.

17. Door-lock mechanism as in claim 16 in which said knob driver is yieldingly biased outward to engage said lug in said knob recess, and said lug and recess are so shaped that excessive knob turning force will cause the lug to be yieldingly cammed to a retracted position to release the drive connection from the knob to the sleeve.

18. Door-lock mechanism as in claim 16 in which the driver and lug are supported against retraction from the neck-portion recess so as to lock the driver lug against retraction and thereby provide a positive drive between the knob and sleeve.

19. Door-lock mechanism as in claim 16 in which the sleeve is formed with a transverse slot adapted to receive either a non-retractable driver and lug for providing a positive drive from the knob to the sleeve or a yieldingly retractable driver having a lug shaped to be yieldingly cammed out of said recess by excessive knob-turning force so as to provide a torque-releasable knob.

20. A door-lock mechanism as in claim 18 or 19 in which said knob portion contains diametrically opposite axially and inwardly open recesses and said sleeve contains a diametric slot, and a positive driver mounted in said slot and having opposite ends engaged in said opposite recesses.

21. Door-lock mechanism, comprising a knob sleeve having a generally cylindrical knob-receiving portion containing a transverse slot for receiving and supporting a knob driver having a drive lug which projects radially from said knob-receiving portion, a knob having a handhold portion and a neck portion, said neck portion having an inner cylindrical bearing surface for supporting the knob for possible rotation on the axis of the sleeve and containing an inner lug-receiving recess open inward and axially toward the inner end of the sleeve so as to be axially engageable and disengageable with the lug of a knob driver mounted in said sleeve, and means to secure the knob axially in place on the sleeve with the recess in position to engage a driver lug, said mechanism being adapted to have the knob mounted on the sleeve either (a) without a knob driver in said slot so as to be freely rotatable on the sleeve, or (b) with a non-retractable driver lug in said slot so as to provide a positive drive from the knob to the sleeve, or (c) with a yieldingly retractable driver in such slot and having a lug thereon shaped to be yieldingly cammed out of engagement with said lug-receiving recess by excessive knob-turning force so as to provide a torque-releasable drive between the knob and sleeve.

22. Door-lock mechanism as in claim 16 or 21 in which said knob has a large circular opening in its outer end, further comprising a face closure member rotatably mounted in said opening and having a generally cylindrical flange at its inner end, said knob sleeve having a forward portion engaged about said flange for supporting the outer end of the knob, said face closure member containing an opening for a key-lock mechanism having a key-plug portion on the axis of the knob sleeve and a lateral tumbler flange, said forward-extending sleeve portion defining a slot in which said flange is received and embraced so as to orient the key-lock mechanism and face closure member about the axis of the knob sleeve.

23. Door-lock mechanism as in claim 22 in which said key-lock mechanism is a key-removable core having a key-retractable retaining lug projecting laterally therefrom, said face closure member having a rearward-facing shoulder thereon behind which said lug is engageable to retain the core in place.

24. Door-lock mechanism as in claim 22 in which said knob opening and face closure member have facing peripheral grooves at the circular interface therebetween, and a retaining ring contained in and bridging said grooves to secure the closure member in said opening.

25. Door-lock mechanism, comprising a generally cylindrical knob sleeve including a forward portion, a knob having a large circular opening in its outer end and having a neck portion surrounding said sleeve and coaxial therewith, a circular face closure member received in said knob end opening, said knob opening and face closure member having facing peripheral grooves at the circular interface therebetween, and a retaining ring contained in and bridging said grooves to secure the face closure member in said opening and rotatable therein relative to the knob, said closure member having a rearward extending flange engaged in the forward portion of the knob sleeve for supporting the outer end of the knob.

26. Door-lock mechanism as in claim 25 in which said face closure member is formed to interengage a key-lock mechanism having a key plug on the axis of the knob sleeve and a lateral tumbler flange and to expose the key plug for operation, said forward portion of the sleeve having an axial slot for receiving said tumbler flange and thereby orienting the key-lock mechanism and the face closure member about the axis of the knob sleeve.

27. Door-lock mechanism as in claim 26 in which said knob is normally held against rotation on the sleeve when the lock mechanism is to be operated by said key-lock mechanism, said key-lock mechanism is removable through the face closure member, and said forward portion of the knob sleeve contains two slots so as to receive the key-lock mechanism in two different orientations, said knob and face closure member forming a self-contained assembly in which said face closure member is rotatable to different orientations, to permit said key-lock mechanism to be inserted in its two orientations while the knob remains fixed and non-rotatable on the knob sleeve.

28. Door-lock mechanism as in claim 26 in which said knob is rotatable on said sleeve under at least some circumstances, said face closure member being oriented relative to the sleeve by the presence of a key-lock mechanism therein, said knob and face closure member forming a self-contained assembly in which said groove and ring mounting permits rotation of the knob relative to the sleeve and face-closure member when the same are held in oriented relation by the presence of a key-lock mechanism.

29. Door-lock mechanism as in claim 25 in which said face closure member contains an unsymmetrical opening for receiving a key-removable lock core having a key plug portion and a tumbler housing extending laterally therefrom, said forward portion of the knob sleeve being formed to interengage with such core to orient the same and the face closure member about the axis of the sleeve and said core having a retaining lug engageable behind a shoulder on said face closure member so as to be held in place relative to the knob by such engagement and by the groove and ring mounting of the face closure member in the knob opening.

30. Door-lock mechanism, comprising a knob sleeve having a forward portion defining a longitudinal slot, a key-lock mechanism having a key plug portion and a lateral pin tumbler flange, said mechanism being mounted with its key plug portion on the axis of the sleeve and at least partially within the forward portion of the sleeve and with its tumbler flange oriented in said slot, a knob mounted for possible rotation on the axis of the sleeve and having a large circular opening in its outer end, a face closure member rotatably mounted in said knob opening, having a flange portion at its inner end engaged with said forward portion of the knob sleeve for supporting the outer end of the knob, and having a portion non-rotatively engaged with said key lock mechanism and exposing the key plug thereof for key operation, said knob opening and face closure member being provided with facing peripheral grooves at the circular interface therebetween, and a retaining ring contained in and bridging said grooves to secure the closure member rotatively in said opening.

31. Door-lock mechanism as in claim 30 in which said key-lock mechanism is a key-removable core having a key-retractable retaining lug projecting laterally therefrom, and engaged behind a rearward-facing shoulder on said face closure member.

32. Door-lock mechanism as in claim 30 in which one of said grooves is of a size to contain the retaining ring and such ring is a resilient ring adapted to be flexibly retracted into such groove as the closure member is mounted in the knob and to snap into the opposite groove when the same comes into alignment therewith.

33. Door-lock mechanism as in claim 23 in which said knob opening and face closure member have facing peripheral grooves at the circular interface therebetween, and a retaining ring contained in and bridging said grooves to secure the closure member in said opening.

34. Door-lock mechanism, comprising a doorknob having a large circular opening in its outer end and having a neck portion for mounting the knob on a knob sleeve or the like, a circular face closure member received in said knob end opening, said knob opening and face closure member having facing peripheral grooves at the circular interface therebetween, and a retaining ring contained in and bridging said grooves to secure the face closure member in said opening and rotatable therein relative to the knob.

35. Door-lock mechanism as in claim 34 in which said face closure member is formed to receive a key-lock mechanism having a key plug on the axis of the knob sleeve and to interengage a lateral tumbler flange of such key-lock mechanism so as to orient the key-lock mechanism and the face closure member with respect to each other about the axis of the knob sleeve, said knob and face closure member forming a self-contained assembly in which said face closure member is rotatable to different orientations, to permit said key-lock mechanism to be inserted in different orientations with respect to the knob.

36. Door lock mechanism as in claim 35 in which said face closure member includes an axially extending portion forming an inward-facing shoulder for engagement by a retainer lug on a key-lock mechanism inserted in the face closure member from the outer face thereof to secure such mechanism in the face closure member.

* * * * *